US009505206B1

(12) United States Patent
Donato

(10) Patent No.: US 9,505,206 B1
(45) Date of Patent: Nov. 29, 2016

(54) CLADLESS ANILOX SLEEVE FOR USE IN FLEXOGRAPHIC PRINTING

(71) Applicant: Harper Corporation of America, Charlotte, NC (US)

(72) Inventor: Anthony Gene Donato, Fort Mill, SC (US)

(73) Assignee: Harper Corporation of America, Charlotte, NC (US)

( * ) Notice: Subject to any disclaimer, the term of this patent is extended or adjusted under 35 U.S.C. 154(b) by 0 days.

(21) Appl. No.: 15/070,222

(22) Filed: Mar. 15, 2016

(51) Int. Cl.
*B41F 31/26* (2006.01)

(52) U.S. Cl.
CPC ..... *B41F 31/26* (2013.01)

(58) Field of Classification Search
CPC ..... B41F 31/26
USPC ..... 101/349.1, 351.7, 352.11; 492/48, 49
See application file for complete search history.

(56) References Cited

U.S. PATENT DOCUMENTS

| | | | | |
|---|---|---|---|---|
| 1,018,457 | A | 2/1912 | Vieser | |
| 1,222,943 | A | 4/1917 | Gammeter | |
| 1,905,871 | A | 4/1933 | Holland | |
| 4,024,816 | A | 5/1977 | Williams et al. | |
| 4,685,393 | A * | 8/1987 | Saueressig | B41F 13/10 101/375 |
| 5,651,316 | A | 7/1997 | DeMoore et al. | |
| 6,082,257 | A | 7/2000 | Secor | |
| 8,100,817 | B2 | 1/2012 | Reichert et al. | |
| 2003/0134732 | A1 * | 7/2003 | Kolbe | B41F 31/26 492/59 |
| 2009/0165662 | A1 * | 7/2009 | Ritchie | B41F 13/10 101/376 |
| 2010/0263563 | A1 * | 10/2010 | Doppler | B41F 13/187 101/375 |

OTHER PUBLICATIONS

Harper Corporation of America, Harper's Exclusive Anilox Sleeve flyer; 2015, all pages enclosed.
Harper Corporation of America, "Sleeve Technology", PowerPoint presentation; 2015, all pages enclosed.
Ehrenberg, Art, "Anilox Sleeves—The Evolution Continues", Flexo Exchange, 2003, Harper Corp., all pages enclosed.

* cited by examiner

*Primary Examiner* — Leslie J Evanisko
(74) *Attorney, Agent, or Firm* — Nelson Mullins Riley & Scarborough LLP

(57) ABSTRACT

A cladless anilox sleeve mountable on a mandrel suitable for commercial use as an anilox roll in flexographic printing. The anilox sleeve of the present invention basically comprises a cylindrical body of a predetermined axial length, the cylindrical body having inner and outer cylindrical peripheral surfaces and end faces at opposite ends of the cylindrical body extending radially between the inner and outer cylindrical peripheral surfaces. The cylindrical body is formed substantially entirely of non-metallic material and without an exterior metallic cladding thereon. Each end face of the cylindrical body has a circular recess formed therein at a radial spacing from the inner and outer cylindrical peripheral surfaces, and a metal ring is secured in each circular recess to promote maintenance of cylindricality of the cylindrical body. Each metal ring extends axially beyond the respective end face for deterring damaging contact therewith.

10 Claims, 2 Drawing Sheets

CLADLESS ANILOX SLEEVE FOR USE IN FLEXOGRAPHIC PRINTING

FIELD OF THE INVENTION

The present invention relates generally to commercial printing operations, especially flexographic printing operations utilizing engraved anilox ink transfer rolls. More particularly, the present invention relates to anilox rolls in the form of a sleeve mountable onto a driving mandrel. Most particularly, the present invention relates to so-called "cladless" anilox sleeves without an exterior metal cladding.

BACKGROUND OF THE INVENTION

In conventional flexographic printing operations, a supply of ink is transferred to and imprinted on a traveling substrate via a series of rotating rolls in sequential peripheral contact with one another. The series of rolls includes a so-called anilox roll which rotates through an enclosed ink chamber in order to take up a film of ink across the width and about the periphery of the anilox roll. The anilox roll in turn is disposed in peripheral contact with a printing roll, often referred to as a plate cylinder, for transferring ink in a metered thin film onto the printing roll for imprinting onto the substrate.

Anilox rolls are engraved, typically either by a mechanical or a laser engraving operation, to produce an array of recesses circumferentially about the peripheral surface of the roll, commonly referred to as "cells." The size, shape and depth of each cell and their relative arrangement and spacing over the peripheral surface of the anilox roll principally determine the thickness or thinness and uniformity of the ink film transferred to the printing roll.

Traditionally, anilox rolls have been fabricated of a cylindrical body of steel or other metallic material with a metallic or ceramic peripheral surface capable of being engraved with a desired cell configuration. An axial drive shaft extends from opposite ends of the cylindrical body for mounting within journaled bearings of a printing press. In more recent years, anilox rolls have sometimes been fabricated in the form of a sleeve mountable onto a drive mandrel in a printing press.

Anilox sleeves offer potential advantages over anilox rolls in weight reduction, attendant ease of handling, and lower cost, but also pose potential disadvantages as the sleeve configuration is more susceptible to a loss of circularity and concentricity and more susceptible to damage. Accordingly, it has been conventional practice to fabricate anilox sleeves with a base of non-metallic layers, e.g., a layered configuration of fiberglass, foam and resins, but with an outer metallic cladding layer, typically aluminum, over the full circumferential periphery and ends of the roll. The non-metallic base provides a degree of resilient expansibility radially under the action of compressed air transmitted through the drive mandrel of a printing press to facilitate slidable mounting of the anilox sleeve onto the mandrel and radial gripping compression about the mandrel upon cessation of the compressed air feed. The metal cladding is generally effective to maintain circularity and concentricity and to protect against damage, and provides a reliable bonding surface for an engravable outer ceramic layer. However, the use of metal cladding adds to the weight and cost of the sleeves thereby mitigating to an extent the potential advantages of a sleeve configuration.

It has been proposed and attempted to fabricate anilox sleeves without metal cladding in order to achieve the maximum benefits of weight and cost reduction. Attempts at such so-called "cladless" sleeves however have been found to be particularly susceptible to loss of circularity and concentricity and to damage from handling. In particular, anilox sleeves can often be subjected to rough handling in the environment of a conventional printing operation due to their relatively lighter weight. Cladless sleeves are especially susceptible to damage to their end edges from being stored in a standing disposition and from contact with the abutment surfaces of a mandrel or a storage rack. Accordingly, to date, cladless anilox sleeves have not met with general acceptance and success within the industry.

SUMMARY OF THE INVENTION

A recognized but yet unsatisfied need accordingly exists within the printing industry for a cladless anilox sleeve that will realize an optimal weight and cost reduction as compared to conventional anilox rolls as well as cladded anilox sleeves.

The present invention seeks to address this existing need by providing a cladless anilox sleeve mountable on a mandrel suitable for commercial use as an anilox roll in flexographic printing. The anilox sleeve of the present invention basically comprises a cylindrical body of a predetermined axial length, the cylindrical body having inner and outer cylindrical peripheral surfaces and end faces at opposite ends of the cylindrical body extending radially between the inner and outer cylindrical peripheral surfaces. The cylindrical body is formed substantially entirely of non-metallic material and without an exterior metallic cladding thereon. Each end face of the cylindrical body has a circular recess formed therein at a radial spacing from the inner and outer cylindrical peripheral surfaces, and a metal ring is secured in each circular recess to promote maintenance of cylindricality of the cylindrical body. Each metal ring extends axially beyond the respective end face for deterring damaging contact therewith.

In contemplated embodiments, the cylindrical body comprises a polymeric resin material. For example, the polymeric resin material may be selected from the group comprising epoxy resins and polyester resins. The cylindrical body may further comprise a textile material impregnated by the polymeric resin material. The cylindrical body may further comprise a core interiorly between the inner and outer cylindrical peripheral surfaces. For example, the core may comprise an expanded foam or elastomer material. A ceramic layer may be formed on the outer cylindrical surface.

In a particular contemplated embodiment, the cylindrical body may comprises a core layer of an expanded foam or elastomer material, a base layer inwardly of the core layer comprising fiberglass cloth impregnated with a polymeric resin material, and an outer layer outwardly of the core layer comprising a non-woven fibrous material impregnated with a polymeric resin material.

Each metal ring preferably extends a relatively short distance from the respective end face of the cylindrical body, e.g., about 1/32 inch. Each metal ring may be bonded within the respective circular recess by an epoxy adhesive.

DETAILED DESCRIPTION OF THE INVENTION

Referring now to the accompanying drawings, a contemplated embodiment of a cladless anilox sleeve in accordance with the present invention is indicated generally at 10. As persons skilled in the art will recognize, the cladless anilox sleeve 10 is of a tubular construction, as more fully described hereinafter, to facilitate mounting onto a drive mandrel in a conventional printing press. The structure and operation of such presses, the drive mandrels used therein, and the manner of mounting of the anilox sleeve thereon are well known within the printing industry and among persons knowledgeable and skilled in the industry, such that it is not believed to be necessary to illustrate or describe such structures and operations.

Figure 1:
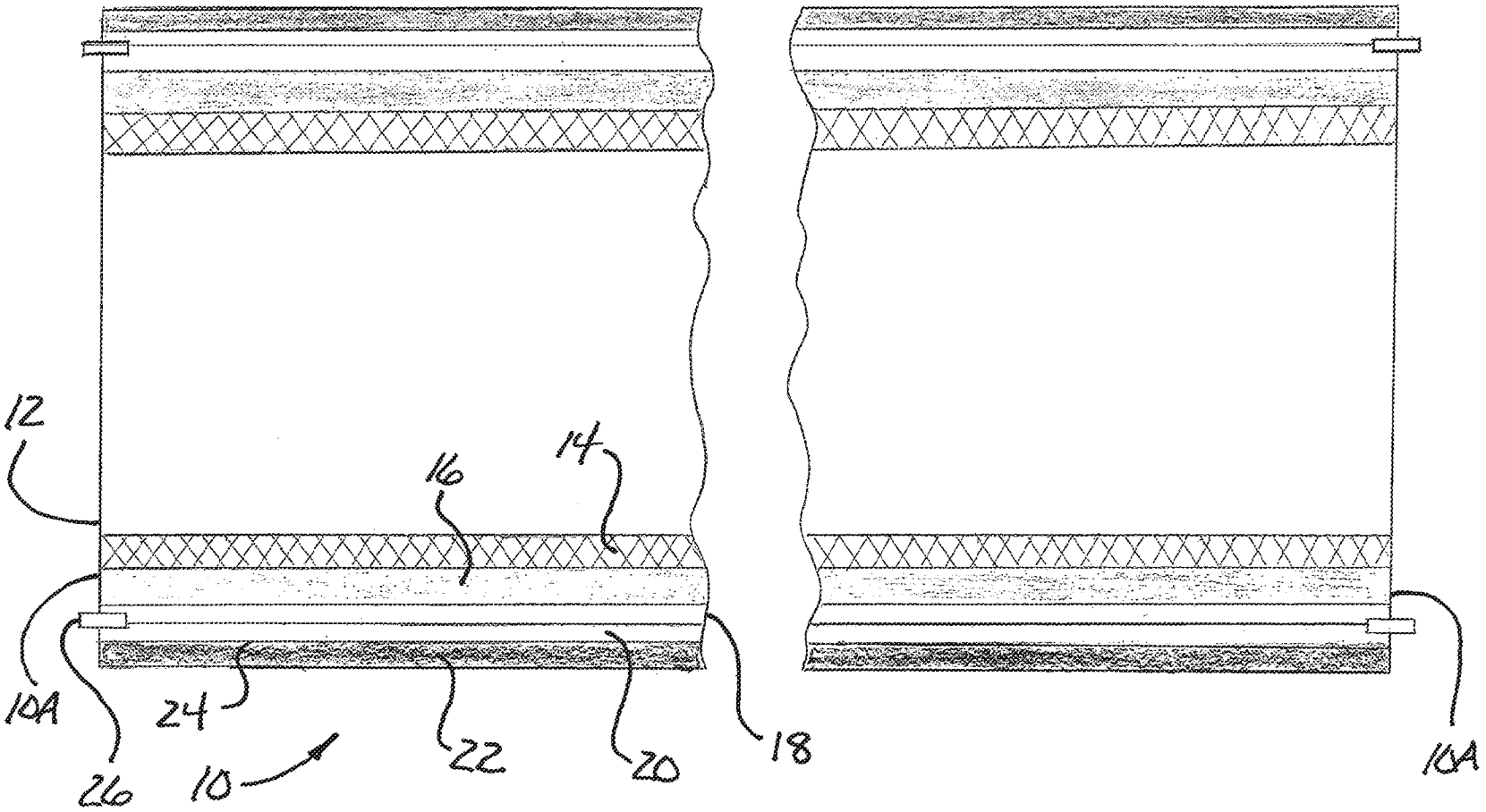
FIG. 1 is a schematic lengthwise axial cross-sectional view of a cladless anilox sleeve in accordance with the present invention.
Figure 2:
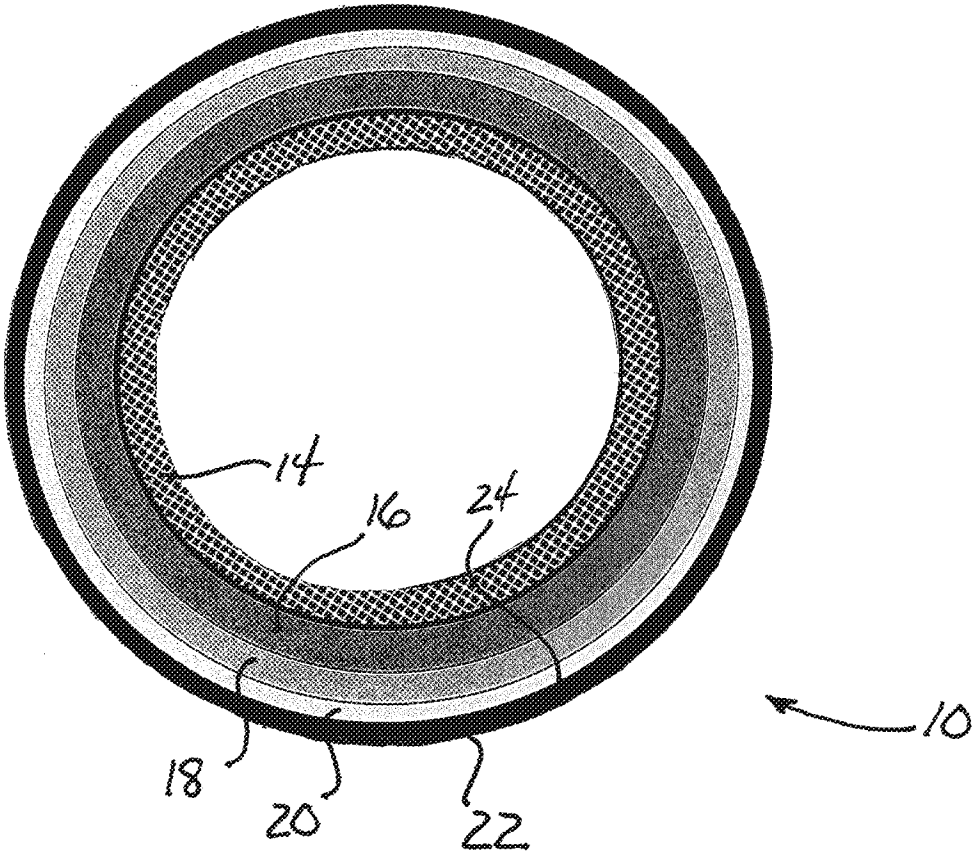
FIG. 2 is a schematic radial cross-sectional view of the cladless anilox sleeve of FIG. 1 taken along line 2-2 thereof.

The cladless anilox sleeve 10 is most fundamentally characterized as having a main cylindrical body 12 formed substantially entirely of non-metallic material and by the absence of an exterior metal cladding. In the illustrated embodiment, the cylindrical body 12 of the cladless anilox sleeve 10 is formed in a composite construction comprised of multiple layers, as depicted in the axial and radial cross-sectional views of FIGS. 1 and 2.

The innermost layer 14 of the cylindrical body 12 is made of fiberglass cloth impregnated with a polymeric resin, wrapped in multiple spiral layers in a cylindrical form, and then cured, forming an inner liner as the inner cylindrical surface of the cladless anilox sleeve 10. Substantially any polymeric resin curable to a solid flexible state may be suitable for use as the resin material, e.g., an epoxy resin or a polyester resin.

A lightweight resilient core layer 16 is intimately bonded concentrically about the liner layer 14 to provide additional built-up structure to the cladless anilox sleeve 10 but with minimal added weight. Substantially any resinous or polymeric material of a low density and resilient expansibility and compressibility may be suitable for use as the core layer 16, e.g., an expanded closed cell polymeric foam or an elastomer that is relatively resilient when cured.

A main resinous layer 18 is formed concentrically about and bonded to the core layer 16. In the illustrated embodiment, the layer 18 is formed of a fibrous non-woven web material impregnated with a polymeric resin, such as an epoxy or polyester resin, wrapped outwardly about and cured in bonded relation to the core layer 16. A monolithic layer 20 in the form of a gel-coating of resin material, which may be the same or a different resin as the main resinous layer 18, is formed about the main resinous layer 18 to provide a machinable surface that can be finished to a precise thickness and a precise degree of cylindricality. In the illustrated embodiment, the gel coating layer is a polyurea coating. AN A uniform layer 22 of a ceramic coating is bonded to the outer cylindrical surface of the gel coating layer 20 to form the outer cylindrical surface of the anilox sleeve 10. The ceramic coating layer 22 is selectively engravable as desired to provide the anilox sleeve 10 with a desirable cell configuration according to the end-use printing application intended for the anilox sleeve 10. A thin coating 24 of zinc may be sprayed or otherwise applied to the outer machined surface of the gel coating layer 20 to promote bonding of the ceramic coating layer 22 to the gel coating layer 20.

The main resinous layer 18, the gel coating layer 20 and ceramic coating layer 22 impart a rigidity to the outer radial thickness of the anilox sleeve 10, while the inner radial thickness of anilox sleeve 10 formed by the liner layer 14 and the core layer 16 has a degree of resiliency effective to expand radially under the action of compressed air transmitted through a drive mandrel of a printing press sufficiently to facilitate slidable mounting of the anilox sleeve 10 onto the mandrel and to recover upon cessation of the compressed air feed to compress into radial gripping engagement about the mandrel.

According to the present invention, each of the opposite radially-extending end faces 10A of the cladless anilox sleeve 10 have a circular metal ring 26 secured thereto. More specifically, in the illustrated embodiment, a circular recess 28 is milled or otherwise formed axially into the main resinous layer 18 at each radial end face 10A concentrically to the cylindrical body 12 and the metal ring 26 is securely bonded within the recess 28, e.g., via an epoxy or other adhesive. Each metal ring 26 extends slightly beyond the respective end face 10A of the anilox sleeve 10, e.g., on the order of about 1/32 inch.

The metal rings provide two advantages in the cladless anilox sleeve 10. First, the metal rings 26 resist deformation of the anilox sleeve 10 in radial and non-axial directions so as to promote the maintenance of the circularity and cylindricality of the anilox sleeve 10. Second, the projection of the metal rings 26 beyond the end faces 10A act as bumpers to contact abutment surfaces or positioning stops within printing presses, and to abut or engage against storage racks, floors and/or other surfaces with which the end faces 10A would otherwise come into contact when being handled or stored, thereby to prevent potentially damaging contact to the ceramic layer 22 or other portions of the end faces 10A of the sleeve 10.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A cladless anilox sleeve mountable on a mandrel for use as an anilox roll in flexographic printing, the sleeve comprising a cylindrical body of a predetermined axial length, the cylindrical body having inner and outer cylindrical peripheral surfaces and end faces at opposite ends of the cylindrical body extending radially between the inner and outer cylindrical peripheral surfaces, the cylindrical body being formed substantially entirely of non-metallic material and without an exterior metallic cladding thereon, each end face of the cylindrical body having a circular recess formed therein at a radial spacing from the inner and outer cylindrical peripheral surfaces, and a metal ring being secured in each circular recess to promote maintenance of cylindricality of the cylindrical body, each metal ring extending axially beyond the respective end face for deterring damaging contact therewith.

2. A cladless anilox sleeve according to claim 1, wherein the cylindrical body comprises a polymeric resin material.

3. A cladless anilox sleeve according to claim 2, wherein the polymeric resin material is selected from the group comprising epoxy resins and polyester resins.

4. A cladless anilox sleeve according to claim 3, wherein the cylindrical body further comprises a textile material impregnated by the polymeric resin material.

5. A cladless anilox sleeve according to claim 2, wherein the cylindrical body further comprises a core interiorly between the inner and outer cylindrical peripheral surfaces.

6. A cladless anilox sleeve according to claim 5, wherein the core comprises an expanded foam or elastomer material.

7. A cladless anilox sleeve according to claim 1 or 6, wherein the cylindrical body comprises a ceramic layer on the outer cylindrical peripheral surface.

8. A cladless anilox sleeve according to claim 1, wherein the cylindrical body comprises a core layer comprising an expanded foam or elastomer material, a base layer inwardly of the core layer comprising fiberglass cloth impregnated with a polymeric resin material, and an outer layer outwardly of the core layer comprising a non-woven fibrous material impregnated with a polymeric resin material.

9. A cladless anilox sleeve according to claim 1, wherein each metal ring extends from the respective end face about 1/32 inch.

10. A cladless anilox sleeve according to claim 9, wherein each metal ring is bonded within the respective circular recess by an epoxy adhesive.

* * * * *